United States Patent [19]

Corbellini

[11] 4,006,701

[45] Feb. 8, 1977

[54] SEGMENTAL SAIL FOR BOATS

[76] Inventor: Glauco Corbellini, Via Carducci, 33100 Udine, Italy

[22] Filed: Mar. 10, 1975

[21] Appl. No.: 556,803

[30] Foreign Application Priority Data

Mar. 8, 1974 Italy ..... 83319/74

[52] U.S. Cl. ..... 114/102

[51] Int. Cl.[2] ..... B63H 9/04

[58] Field of Search ..... 114/39, 102–103, 114/108–109, 111–115, 205

[56] References Cited

UNITED STATES PATENTS

| | | | |
|---|---|---|---|
| 520,955 | 6/1894 | Evans | 114/109 |
| 1,504,057 | 8/1924 | Koelkebeck | 114/103 |
| 1,516,063 | 11/1924 | Scammell | 114/103 |
| 3,444,834 | 5/1969 | Bever et al. | 114/102 |
| 3,581,698 | 6/1971 | Bete | 114/102 |

FOREIGN PATENTS OR APPLICATIONS

| | | | |
|---|---|---|---|
| 693,829 | 8/1965 | Italy | 114/102 |

*Primary Examiner*—Trygve M. Blix
*Assistant Examiner*—Jesus D. Sotelo
*Attorney, Agent, or Firm*—A. W. Breiner

[57] ABSTRACT

A sectional sail for boats includes a plurality of sections parallel to one side of the sail, each section being provided with tensioning ropes or luff- and leech-ropes and devices for tensioning and tightening the sail. Stiffening battens are provided for maintaining a constant distance between the edges for entry and exit of the wind between the sections. Connectors are included for securing the ends of the sections, as are connectors for connecting the edges thereof. The ends of the sections are substantially aligned and axially successive. The sail, which is practical, simple, and safe, enables one to exploit the thrust of the wind to the maximum extent possible.

17 Claims, 18 Drawing Figures

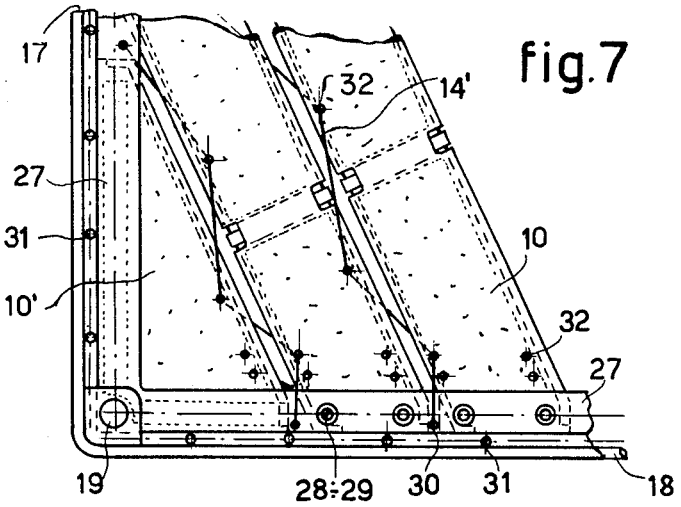
fig.7
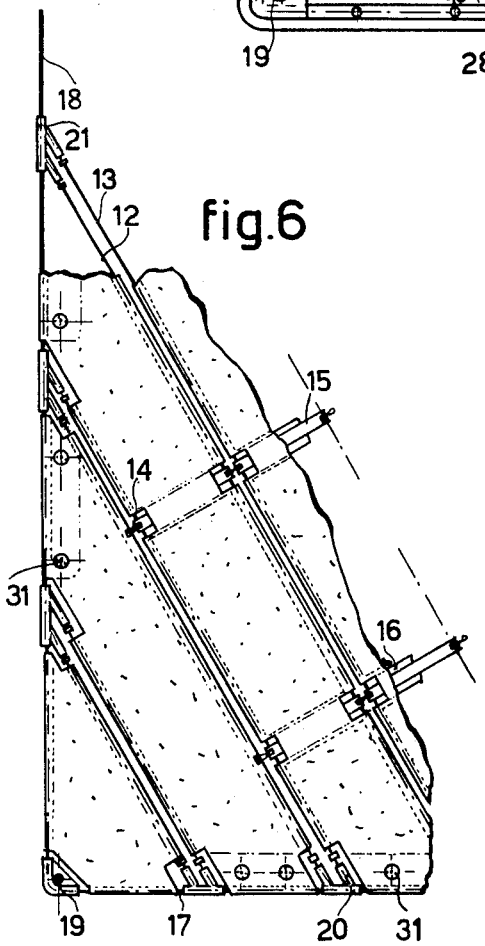
fig.6
fig.8
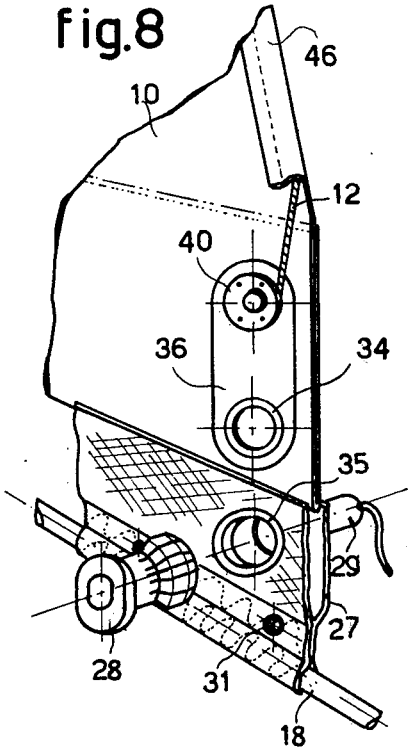

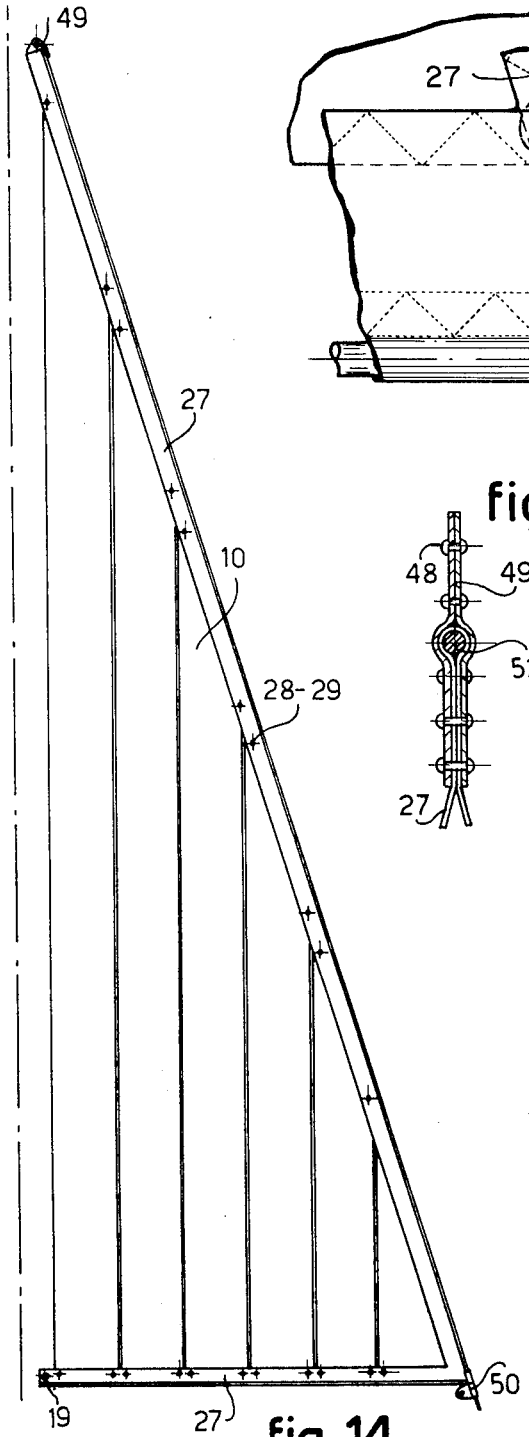
fig. 14
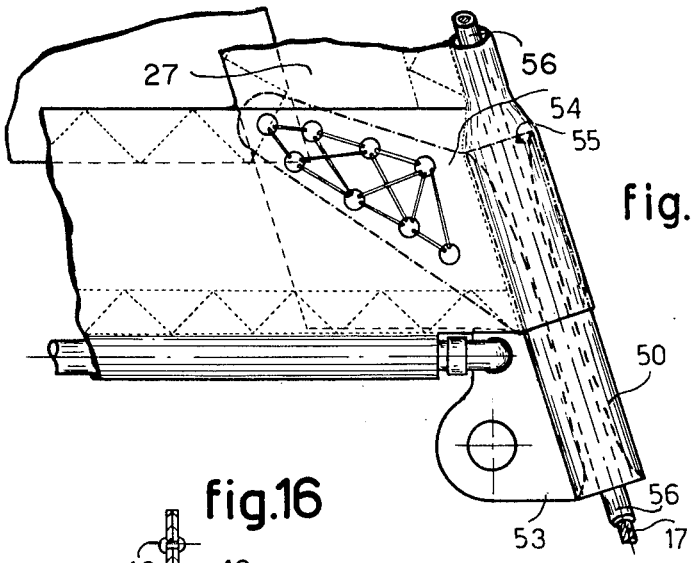
fig. 18
fig.16
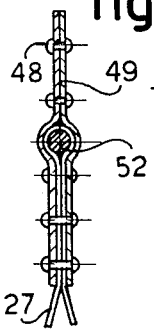
ON LINE B-B OF FIG. 15
fig.17
ON LINE A-A OF FIG. 15
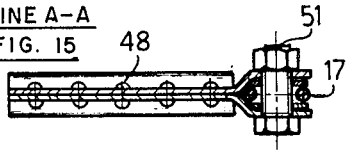
fig.15
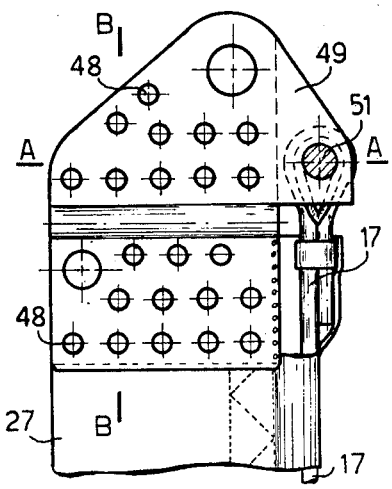

SEGMENTAL SAIL FOR BOATS

FIELD OF INVENTION AND BACKGROUND

The present invention is directed to a sail with segments especially suitable for boats. A primary object of the invention is to improve the ease in handling and the level of safety of a sailing boat, and also to make less difficult the operations required for keeping the sail in a strong wind.

The principles are well-known whereby a sail subjected to the action of the wind is able to impart to a boat a movement whose direction together with the direction of the wind subtends an angle of less than 90 degrees. Under such conditions, the boat moves towards the wind. This type of movement is called "sailing close-hauled," and it together with the other movements, "sailing with the wind on the beam" or "sailing with the wind astern," provides a sailor with freedom of movement in all directions when the only motive force is that supplied by the wind.

By sailing close-hauled it is possible to reach a position to windward by using those typical maneuvers which consist of "tacking." These maneuvers cause the boat to carry out a zig-zag course and to present first one side and then the other to the wind until the boat reaches its destination. This is easy with moderate winds; but, when the force of the wind increases, the action on the sails in sailing close-hauled becomes more and more critical since the boat tends to heel over more and more in the direction towards which the wind is blowing. So as not to capsize under such conditions, it becomes necessary to reduce the surface of the sail. This in turn reduces the aerodynamic efficiency of the sail and the motive thrust. When the wind is strong, almost all maneuvers such as wearing ship, hoisting, and hauling down sails, etc., become difficult.

OBJECTS AND GENERAL DESCRIPTION OF INVENTION

A primary object of the present invention is to increase the aerodynamic efficiency of the sail at all times and especially when there is a strong wind.

Another object is to make it possible for a boat to sail close-hauled and grip the wind at a smaller angle than that possible with a sail of a traditional kind.

Another object is to permit one to sail close-hauled even in strong winds without causing the boat to heel over excessively.

Another object is to make it easy to carry out maneuvers which would otherwise be difficult in strong wind conditions, such maneuvers being, for example, wearing ship, hoisting, and hauling down the sail; taking in reefs to reduce the surface of the sail, etc.

A further object is to enable one to reduce the surface of the sail quickly while maintaining an aerodynamically perfect sail.

The above objects provide a plurality of advantages. More specifically, it is an advantage for a boat to sail close-hauled and grip the wind at smaller angles than those possible with a sail of a traditional kind. It is also an advantage to be able to maintain such a position when the winds are strong without causing the boat to heel over dangerously. A further advantage is the simplification and consequent ease with which the said maneuvers of wearing ship, hoisting, and lowering sails; taking in reefs to reduce the surface of the sail, etc., can be carried out in strong wind.

The objects are accomplished and the advantages are obtained according to this invention by dividing a traditional sail into so many elementary pieces in the form of segments and by orienting the layout thereof at the correct angle relative to the wind, thereby causing the wind to lap the segments and to deviate its direction and at the same time to supply the desired thrust. By the shape of the segments and the reciprocal positioning thereof, the maximum deviation of the wind currents is obtained without slowing up these currents excessively. This eliminates the passive resistance with which a traditional sail reaches significant values with an increase in the wind speed. Next, the fact that the various segments can be separated and that some of them can be removed quickly when the sail is thus divided up makes it possible to reduce the surface of the sail while maintaining aerodynamically valid forms.

The objects and advantages detailed, together with further objects and advantages, are thus attained with a segmental sail for boats which is characterized by the fact that it includes in combination and reciprocal cooperation —

— a plurality of segments parallel to one side of the sail, each segment being provided with
— tensioning means or luff- and leech-ropes and devices for the tensioning and tightening thereof;
— stiffening battens to keep constant the distance between the edges for entry and exit of the wind between the segments;
— means for securing the ends of the segments;
— means for connecting the edges of the segments, and
— the ends of the segments being substantially aligned and axially successive.

It should be borne in mind that the designs given in the realization of the invention are generically three in number, the designs for the structure itself of the sails being as follows:

"*a*" — segments parallel to the mast (this design is shown in FIGS. 14 to 16);
"*b*" — segments parallel to the boom;
"*c*" — segments parallel to the depth-leech or after-leech (this design is shown in FIGS. 3 to 6 and 7).

The invention will now be explained by making use of the attached drawings which have been provided as non-limitative, preferential examples, wherein —

FIG. 6 illustrates in detail the part of the sail of FIG. 3 that includes the tack at a substantially right angle.

FIG. 7 illustrates another system for attachment of the segments to the mast and boom.

FIG. 8 illustrates a preferred system for fixture of the segments to the borders into which the boltrope is inserted.

FIG. 14 illustrates a jib which in this case has its segments parallel to the mast.

FIGS. 15 to 18 illustrate two attachments as adopted in the design of FIG. 14.

Figure 1:
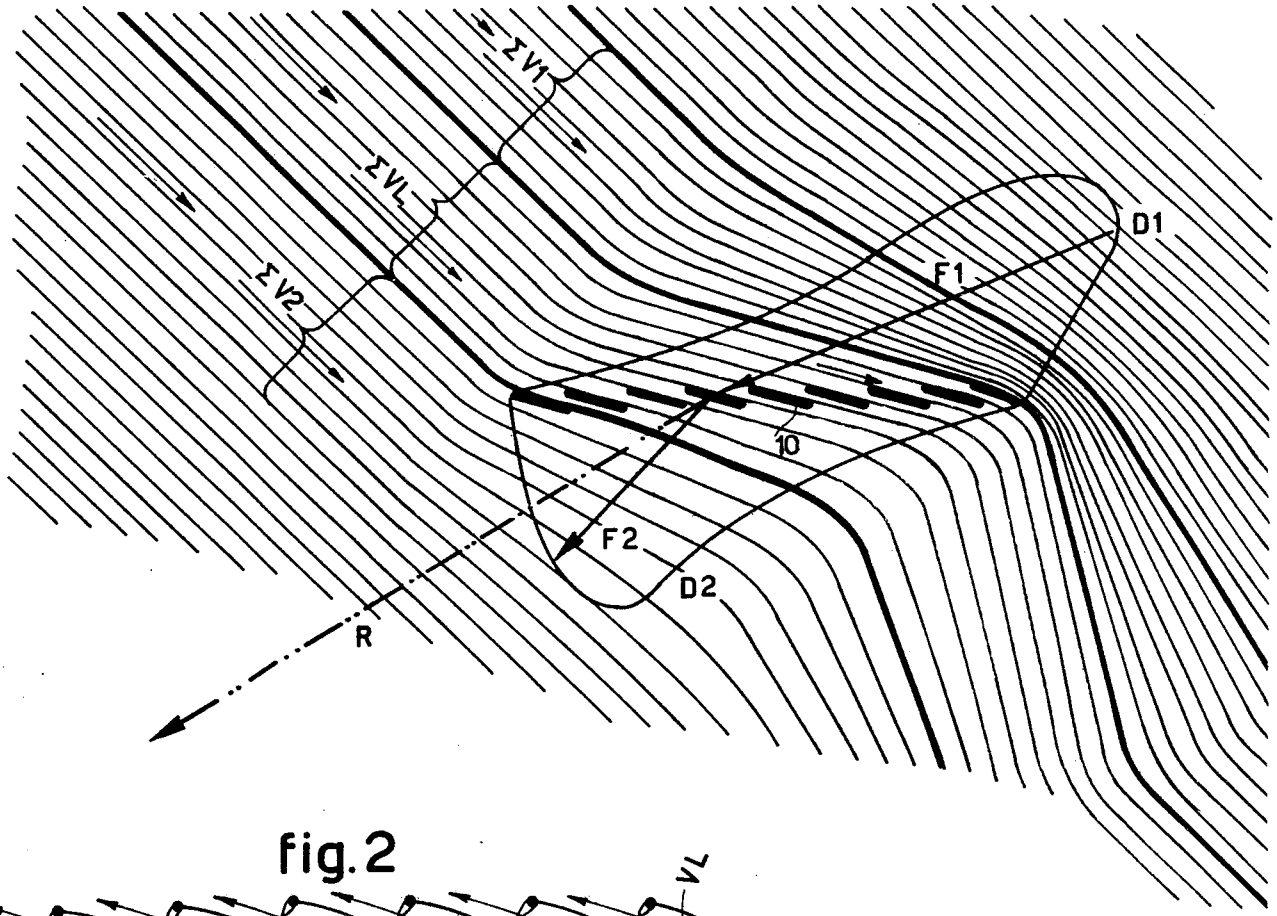
FIG. 1 illustrates a transverse section of the sail which is the subject of the invention.
Figure 2:
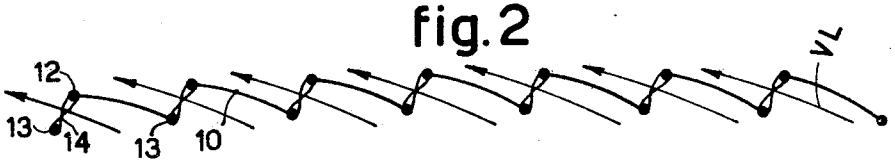
FIG. 2 illustrates in more detail a section of the sail of FIG. 1 and indicates the course of the wind currents.
Figure 12:
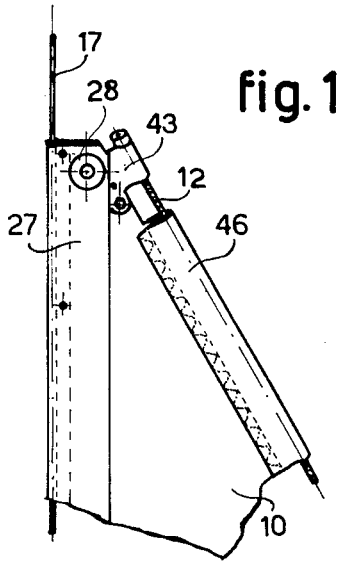
FIG. 12 illustrates a part of a sail with a preferred device for upper fixture of the luff- and leech-ropes.

With reference to FIGS. 1 and 2, it can be seen that the sail is not continuous but comprises an assembly of parallel segments disposed in rows in accordance with a fixed reciprocal position or the like. It can also be seen that the segments are secured in a fixed reciprocal position along the mast and boom and, more generically, along the connection ends of the segments themselves. Furthermore, the segments along the mast and boom can be fixed either directly by using earing ropes or boltropes (FIGS. 3 and 6) or by interposing suitable borders (FIGS. 7 and 12). In any case, the fixture of the segments at no time arranges for them to be adjusted at an angle.

It can also be seen how the wind passes between the segments, brushes over them, and has its lifting action increased by the openings, which are accentuated up to a certain point and over a certain part of the segments (the central part, with a decrease towards the areas of fixture) by the action of the wind. We have shown this by making use of the relative pressure curves, which in our example are represented together with the partial components produced by them and with the resulting force of thrust on the sail. In accordance with the concept of the invention, it is precisely the exact tightening of the ropes positioned at the sides of the segments and especially of the rope along the attachment edge that causes the sail to obtain its special characteristics in accordance with the invention.

Figure 3:
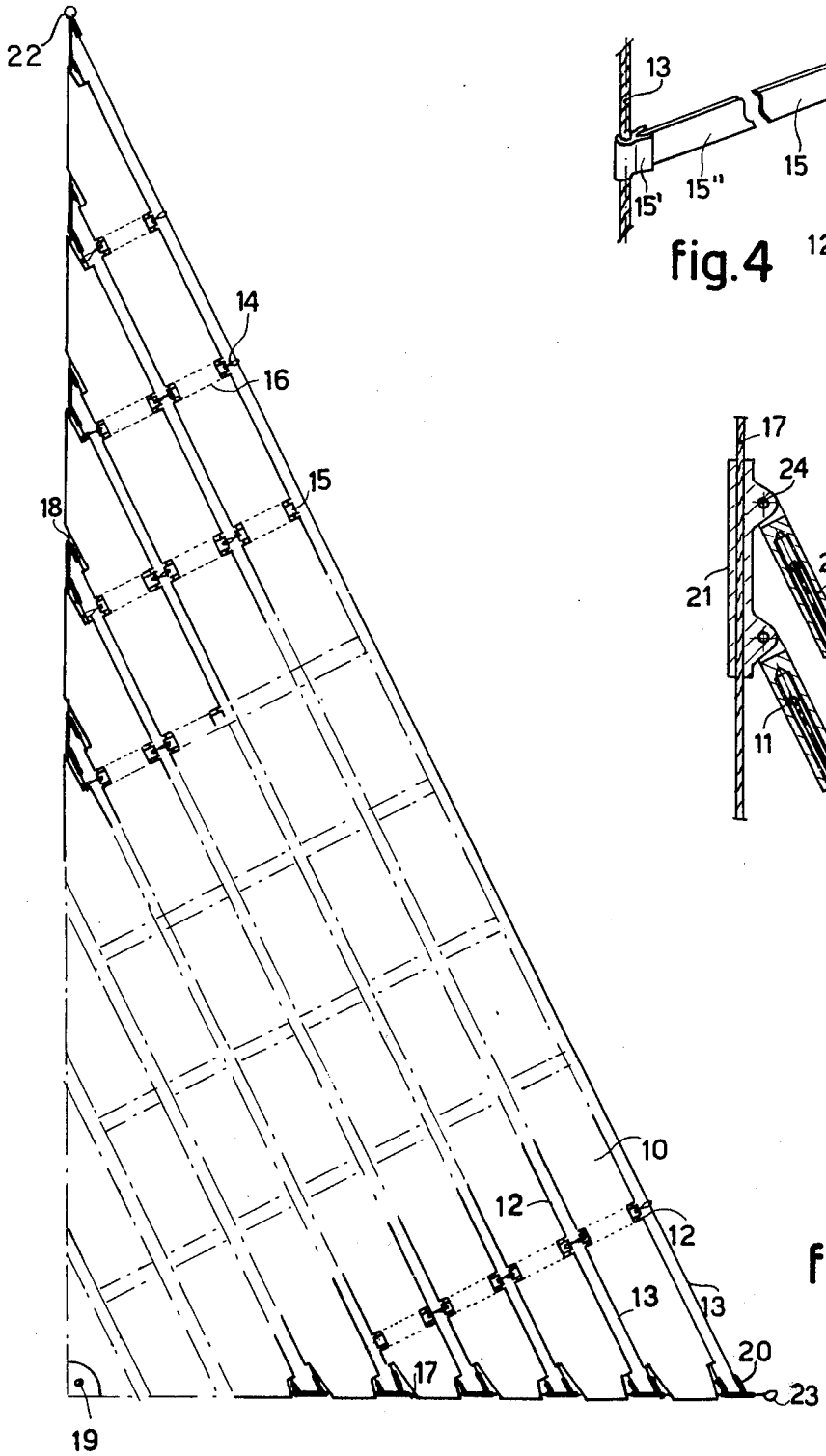
FIG. 3 illustrates a side view of the sail with the segments parallel to the discharge side of the sail itself (after leech).
Figure 4:
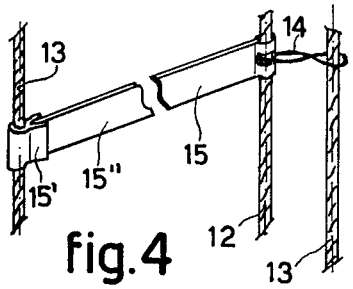
FIG. 4 illustrates a batten or spacer strut which is suitable for spacing out the tensioning ropes or luff- and leech-ropes.
Figure 10:
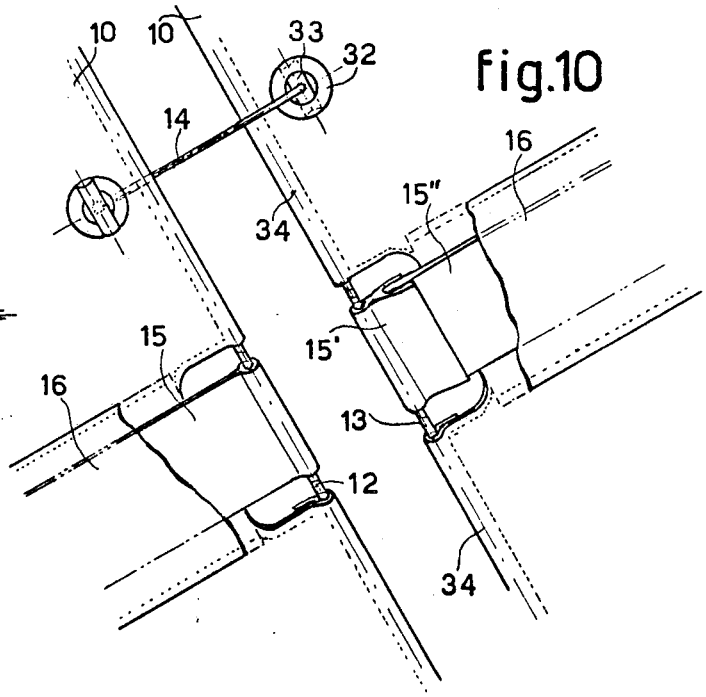
FIG. 10 illustrates a preferred system for fixture of the little sheets and two different types of battens.

From the figures it can be seen how battens for spacing out the edges for entry and exit of the wind between the segments have been provided (FIGS. 4 and 10 in detail; FIGS. 3, 6, 7, and 12 is an assembly); and how the entry edge of one segment and the adjacent exit edge of the preceding segment are reciprocally governed by little sheets, which may be of various types (FIGS. 2, 3, 4, 6, 7, 10, and 11) but always have the same function.

In the drawings the same parts or parts having the same purpose have been given the same reference numbers. With reference to FIG. 1, V1, V2, and VL indicate the currents which compose the flow of wind in accordance with their temporary position relative to the sail. The currents V1 and VL flow to windward and the current V2 down wind in respect to the sail. D1 indicates the diagram of the windward pressures exercised by the wind on the sail, while F1 indicates the resulting component of said pressures. D2 indicates the diagram of the down wind depressions generated on the sail, while F2 indicates the resulting component of said curve of the depressions. The component resulting from the sum of the forces F1 and F2 is indicated by R. The flow of wind, which with its currents VL affects the segments 10 constituting the sail, is localized for illustrative purposes by two thick lines that are intended to indicate approximately the course imposed on said flow by the configuration of the sail. The tracing of the wind currents and of the diagram of the pressures D1 and depressions D2 as well as of the resulting forces has been provided so as to clarify the principle of the action of the segments 10 placed in the flow of wind and so as to illustrate the results which said segments 10 bring about. However, this may be caused to vary by their reciprocal temporary position, which depends on various factors or combinations thereof, such as (1) the speed V of the wind; (2) the characteristics of the segments (their sizes, number, and position); (3) the reciprocal position of the segments relative to the wind and boat; (4) the dimensions of the sail itself; (5) the tightening of the tensioning ropes provided at the edge, etc. The segments 10 may be made of reinforced fabric with suitable supports or impregnations, or else of a flexible or partially flexible plastic material.

Figure 11:
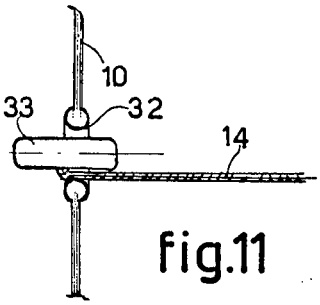
FIG. 11 illustrates the system for inserting or withdrawing the little sheets from the segments in the solution of FIG. 10.
Figure 13:
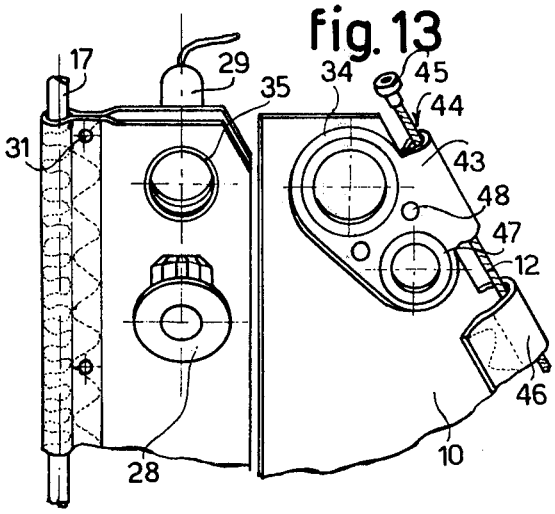
FIG. 13 illustrates in detail the device for the upper fixture of the luff- and leech-ropes or tensioning means to the segment.

In FIG. 2, 12 and 13 are the tensioning ropes positioned at the exit and entry of the segment, respectively. Hereafter these ropes will be more correctly called "luff"- and "leech"- ropes. These luff- and leech-ropes 12 and 13, except at the areas of anchorage of the battens 15, described more fully hereinafter, run inside sheathings 46 applied to or obtained with the edge of the segment itself 10. 14 indicates the connections provided between one segment and another, and these connections will hereafter be called "little sheets." These connections may be of a ring type, as in the example shown in FIG. 4, or of a continuous-thread type linked in a zig-zag manner as shown in FIG. 7, or else of a single-thread type with a retaining bar 33 in the eyelet 32, as in FIGS. 10 and 11. The little sheets have the function of keeping the segments united both during assembly of the sail and also when the sail is flapping. They should be capable of being operated quickly so as to make possible the easy and rapid removal of the segment whenever it is necessary to reduce the area of the sail. The little sheets 14 may be made of elastic or partially elastic materials. In the design of FIGS. 3 and 4, they, 14, carry out their function directly by connecting the fore or luff-rope of the entry edge of one segment to the aft or leech-rope of the exit edge of the preceding segment. The little sheets shown in FIGS. 7, 10, and 11 carry out their function by acting on eyelets 32 applied close to the edge of the segments. Such eyelets may be opposed to each other (FIG. 10) or staggered (FIG. 7) alternatively. The little sheets of FIGS. 10 and 11 permit a very simple operation for their extraction and mounting since it is enough to operate as shown in FIG. 11.

In FIG. 3 struts 15 or battens for spacing out the luff- and leech-ropes are illustrated, and these are also shown in FIGS. 4 and 10. They are inserted in appropriate pockets 16 provided in the segments and are secured to the entry luff-rope 12 and the exit leech-rope 13 of each single segment. These battens may be of varying types, see the two designs shown in FIG. 10 for eample. In FIG. 10 the batten 15 is one single piece, being contained in the appropriate pocket 16 and secured to the luff- and leech-ropes 12 and 13. If the batten 15 is broken, it is necessary to withdraw the luff- and leech-ropes 12 and 13 so as to replace the said batten 15. The batten 15′ and 15″, on the other hand, consist of three elements, of which two, 15′, are the same as each other. The attachments 15′ are inserted over the luff- and leech-ropes 12 and 13, and each of them contains a seating within which the batten 15″ is placed. The batten 15'' is lodged inside the appropriate pocket 16 and can be easily withdrawn and replaced in case of breakage. The batten shown in FIG. 4 is illustrated in accordance with the two designs shown in FIG. 10 and described above. Moreover, the batten 15 contains in its head a hollow within which the little sheet or ring 14 is lodged.

Referring again to FIG. 3, 17 and 18 indicate the earing ropes or boltropes onto which the segments may be secured either directly (FIGS. 3 and 6) or by interposing an appropriate border 27 (FIGS. 7 and 8). The fixture does not permit angular orientation of the segments. With certain kinds of masts or booms, however, the segments may also be inserted into appropriate slots or may be connected to them by means of sliding blocks or sliding clew-irons.

In FIG. 3, 19 indicates the connection at the corner between the mast and boom. This connection is also called the "tack." 20 indicates a type of turnbuckle for the luff- and leech-ropes 12 and 13, shown more clearly in FIG. 5. 22 and 23 refer to the connection means which have securing and tensioning functions. These connection means consist of an eyelet or an anchorage hole or of some other normal system used for the purpose, the eyelet 22 being called the "horn ring" and the eyelet 23 the "clew-ring."

Figure 5:
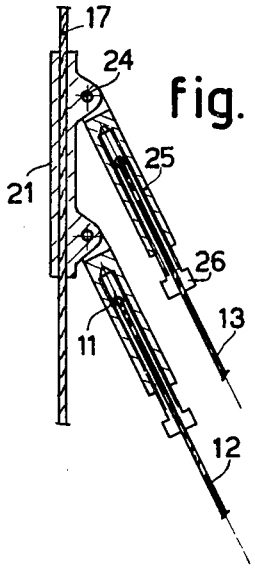
FIG. 5 illustrates a preferred device for tightening the ropes positioned at the sides of entry and exit of the wind within the segments.

The turnbukcles shown in FIG. 5 foresee that the end part of the luff- and leech-ropes 12 and 13 should be enlarged so that it cannot come out through the axial hole present in the threaded rod 26, which itself can be screwed into the sleeve 25. This latter 25 pivots at 24 on the support 21, which in turn is clamped onto the earing rope 17. By screwing or unscrewing 26, the luff- and leech-ropes 12 or 13 are tightened or slackened without being twisted.

The design given in FIG. 5 may be replaced with other means, such as turnbuckles with opposed right-handed and left-handed screws, wedge-type tensioners with adjusting screw, eccentric-cam type tensioners, etc.; and, more generally, with any normal means adopted in known systems for adjusted and adjustable tightening of ropes. A preferred design for the tensioning device is shown in FIGS. 8 and 9, wherein there is also illustrated a rapid system for hooking up and unhooking the segment to and from the border 27.

While in the designs shown in FIGS. 3 and 6 the segments are secured directly to the boltropes 17 and 18, in the preferential designs of FIGS. 7, 8, 9, 12, and 13, the segments are secured to the boltropes 17 and 18 with the interposition of a border 27. Border 27 contains some eyelets 35, corresponding to eyelets 34 in the segments 10. Reciprocal anchorage can be obtained with an expanding pin 28 containing an external peripheral thinner area, some radial notches at one end and an axial boring. The expanding pin 28 is inserted into the eyelets 34 and 35; 34 being, for example, positioned between two eyelets 35. Olive-shaped pin 29 is inserted into the axial boring of 28 and clamps the eyelets 34 and 35 in the thinner area provided on the expanding pin by causing the part of said pin containing the radial notches to expand. The presence of a small cord axial to the olive-shaped pin 29 makes the handling thereof very simple.

Figure 9:
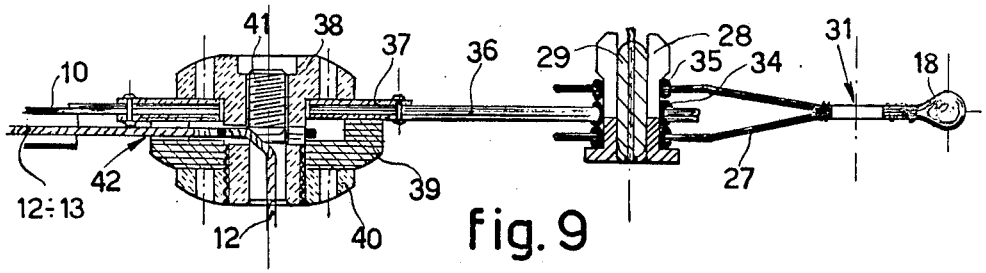
FIG. 9 illustrates, in section and in an assembled condition, that which has been shown in FIG. 8.

The system shown in FIGS. 8 and 9 for tightening the luff- and leech-ropes arranges for the tightening device to be stiffened together with the eyelet 34 by means of at least one flange 36. The tightening device consists of four elements 38, 39, 40, 41, wherein 38 is a pin with a retaining head, with external threading, with a threaded axial bore and a perpendicular bore and may have holes or catches for clamping by means of a key; 39 is a flange with a frontal hollow area and a radial slit 42; 40 is the clamping ring nut which screws onto the pin 38 and serves to compress the flange 39 and clamp it; and 41 is a locking screw, for example, with a hexagonal hollow in its head. The device functions as follows: the luff- and leech-rope 12 or 13 is inserted into the slit 42 and then into the boring perpendicular to the axis of the pin 38 where it is clamped by means of screw 41. See FIG. 9. By acting on the head of the pin 38 with the ring nut 40 slackened off, it is possible to make the luff-rope or leech-rope rotate on the pin 38 within the hollow present within the flange 39. When the desired tightening has been obtained, the ring nut 40 is screwed up and the leech-rope is clamped at its temporary tightening position. In FIGS. 7, 8, and 9 there is shown the eyelets 31 for the fixture of the clew-irons or grummets for securing a sail to the mast or boom. In FIGS. 12 and 13 a preferred device is shown which can be adopted for securing the leech-rope at that end thereof which is without the tightening device. From trials carried out it has been noted that there are conditions in respect of the sizes of the segments that make it possible to provide only one luff-rope at the edge where the wind enters, whereas at the exit edge it is possible to apply a leech-rope sewn on without any special need for tightening. The design of FIGS. 12 and 13 provides for a metal flange 43 with a drilled guide 44 within which the luff-rope or leech-rope 12 or 13 is inserted. The luff-rope or leech-rope 12 or 13 bears at its end a retaining enlargement 45, which cannot pass through the bore of the guide 44. The flange 43 is secured to the segment 10 by means of an eyelet 34, and may include an auxiliary eyelet 47 and rivets 48. This device makes it possible to carry out tightening along the lower side of the segments 10 positioned along the boom.

The method of functioning and the maneuverability of a sail, as shown herein, during the various phases in accordance with the possible preferential design will now be described. Tack 19 is connected to the appropriate fixture point provided on the mast. Fixture to the boom and mast is carried out with clew-irons or other securing means and the sail is lashed by tensioning of the halyard. All this is done as if an ordinary sail were being positioned. Sections 10, although they represent a fragmented surface as compared to an ordinary sail, are prevented from twisting around because they are connected one to another by the little sheets 14. Like a traditional sail, the sail which adopts the sections 10, as soon as it has been hoisted, requires a continuous load downward to apply itself to the boom so as to keep the attachment edges of the sections 10 stretched with a view to forming and maintaining the openings between one section and another. Otherwise, these openings would be eliminated or reduced if the sail tended to bend, and this is a phenomenon which already takes place and is permitted to a certain extent with a view to the general elasticity of the whole complex since the materials are partially stiff and/or partially elastic. When the sectional sail is hoisted, it is oriented in relation to the wind and, thus, acts like a traditional sail. By acting on the luff-rope or leech-rope 12 or 13 positioned in each single section and by slackening off or tensioning one or the other or both, we proceed instead withdraw to tighten up. Tightening of the luff-ropes and leech-ropes 12 and 13 is carried out with the appropriate turnbuckles, as shown and described. Whenever the wind force increases and it becomes necessary to carry out the operation called "taking in a reef," we proceed to loosen off the halyard or rope provided on the mast for hoisting and tensioning. The expanding pins 23 are extracted, the little sheets 14 are detached and all the necessary sections are removed. Reduction of the surface of the sail is always carried out by removing the section 10 positioned on the side of the depth-leech. If it is not enough to remove one, then two or three, etc., may be removed. The sections removed are placed ready for remounting whenever the wind drops. If during sailing a batten 15 is broken due to a mistaken maneuver or some other reason and the design of a batten 15'—15'' in three pieces (FIG. 10) has been adopted, it is sufficient either to slacken the halyard, if the batten is high up, or to reduce the tension on the leech-ropes so as to be able to withdraw the stumps of the strut 15'' and to replace it with a new strut.

From the above it can be seen how the disclosed design provides a practical, simple, and safe sail which enables one to exploit the thrust of the wind to the maximum extent possible.

Referring now to FIG. 14 and the following figures, there is described a sail wherein the sections, which have been amply illustrated in the figures and in the previous description, are substantially parallel to the mast. In particular, these figures relate to a jib. In the type of job shown in FIG. 14, the sections 10 are fixed to the borders 27 in a substantially vertical position. The system for securing the sections 10 to the borders 27 is identical to one of the systems previously detailed. The border 27 has within itself a tightening rope 17 or stay wrapped in a protecting sheath 56. At its lower end the rope 17 is connected to the boom in a known manner. At its upper end, on the other hand, it is connected to the activating rope or halyard by means of the plate 49, onto which it is secured with the pin 51. The border 27 is connected to the plate 49 by means of a series of rivets 48 and a cable 52, around which it is wrapped in an appropriate seating provided in the two elements of the plate 49. At their lower end, the borders 27 in our example, of which one is substantially horizontal and the other vertical, are joined to a guide shell 50 with a gusset 54 for securing the borders 27 and with a gusset 53 for tightening the whole. The shell 50 is able to run along the rope 17–56 and has a bore 55 with its terminals rounded to prevent wear. In this jib sail as well, the sections 10 are the same as those described and shown previously. It is known, however, that jibs are of various kinds and have various postions of usage relative to the mast and/or the boom. In any case, what has been said heretofore regarding the temporary position of the sections in the jib and, more generically, in the sail still holds true.

We have described here general and special designs of the invention, but others are possible without thereby departing from the essence thereof. Thus, it is possible to modify the disposition of the sections, their size, their number, and their temporary position. It is also possible to provide other types of little sheets or tightening devices. Furthermore, it is possible to provide other types of battens and of fixture systems, etc., and at the same time to remain within the compass of the inventive idea.

It is claimed:

1. A sectional sail for boats including in reciprocal combination and cooperation a plurality of sections parallel to one side of the sail, each of said sections being provided with a luff-rope and a leech-rope at the fore and aft vertical edges of said sections, and means for tensioning and tightening said ropes; stiffening battens arranged on said sections betwen said luff- and leech-ropes and extending substantially from edge to edge of said sections for maintaining a constant distance between the edges for entry and exit of the wind between said sections; means for securing the ends of said sections, and means for connecting the edges of said sections, said ends of said sections being substantially aligned and axially successive.

2. The sectional sail of claim 1 wherein said sail is triangular and said sections are parallel to one side of the triangle.

3. The sectional sail of claim 1 wherein said sail is polygonal and said sections are parallel to at least one side of the polygon.

4. The sectional sail of claim 1 wherein the tightening of the luff- and leeech-ropes can be adjusted and is brought about with means which operate gradually.

5. The sectional sail of claim 4 wherein the means for gradually tightening the luff- and leech-ropes have a threaded sleeve and a threaded rod which cooperate mutually.

6. The sectional sail of claim 1 wherein the tensioning means consist of boltropes and stays.

7. The sectional sail of claim 1 wherein the tensioning means consist of boltropes or stays which cooperate with a border containing a plurality of eyelets.

8. The sectional sail of claim 1 wherein the means for tightening the luff- and leech-ropes are secured to at least one boltrope or stay.

9. The sectional sail of claim 1 wherein the means for tightening the luff- and leech-ropes are secured to at least one border that cooperates with at least one boltrope or stay.

10. The sectional sail of claim 1 wherein the means for tightening the luff- and leech-ropes are secured to at least one end of each of said sections.

11. The sectional sail of claim 1 wherein said sections are secured at their ends to boltropes or stays and lie substantially on a plane passing through the axis of said boltrope or stay.

12. The sectional sail of claim 1 wherein said sections are secured at their ends to border means and lie substantially on a plane passing through the axis of boltropes or stays.

13. The sectional sail of claim 1 wherein the means for securing said sections can be removed.

14. The sectional sail of claim 1 wherein spacer battens having two attachment elements are applied to said luff- and leech-ropes and contain a seating for a spacer element.

15. The sectional sail of claim 1 wherein spacer battens are contained in holding pockets present in said sections.

16. The sectional sail of claim 1 wherein the means for connecting the ends of said sections connect the entry edge of one section to the exit edge of the preceding section.

17. A sectional sail for boats including in reciprocal combination and cooperation a plurality of sections parallel to one side of the sail, each of said sections being provided with a luff-rope and a leech-rope at the fore and aft vertical edges of said sections, and means for gradually tensioning and tightening said ropes; stiffening battens for maintaining a constant distance between the edges for entry and exit of the wind between said sections; means for securing the ends of said sections, and means for connecting the edges of said sections, said ends of said sections being substantially aligned and axially successive; and said means for gradually tensioning and tightening said luff- and leech-ropes having in reciprocal cooperation and combination a pin with a retaining head with external threading, with a threaded axial bore and a perpendicular bore; a flange which is frontally hollow and has a radial slit; a locking ring nut cooperating with the external threading of the pin, and a clamping screw cooperating with the axial threaded bore of the pin.

* * * * *